US009162485B2

(12) United States Patent
Ohba et al.

(10) Patent No.: US 9,162,485 B2
(45) Date of Patent: Oct. 20, 2015

(54) TREATMENT LIQUID APPLICATION DEVICE AND IMAGE FORMING SYSTEM

(71) Applicants: Tetsuya Ohba, Ibaraki (JP); Akitomo Kuwabara, Ibaraki (JP); Hironori Numata, Ibaraki (JP); Masaru Hoshina, Ibaraki (JP); Kahei Nakamura, Ibaraki (JP)

(72) Inventors: Tetsuya Ohba, Ibaraki (JP); Akitomo Kuwabara, Ibaraki (JP); Hironori Numata, Ibaraki (JP); Masaru Hoshina, Ibaraki (JP); Kahei Nakamura, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/202,647

(22) Filed: Mar. 10, 2014

(65) Prior Publication Data

US 2014/0253652 A1 Sep. 11, 2014

(30) Foreign Application Priority Data

Mar. 11, 2013 (JP) ..... 2013-047989
Oct. 30, 2013 (JP) ..... 2013-225744

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
CPC ..... B41J 2/211; B41J 2/2114; B41J 11/0015; B41M 5/0011; B41M 5/0017
USPC ..... 347/101
See application file for complete search history.

(56) References Cited

U.S. PATENT DOCUMENTS

| | | | | | |
|---|---|---|---|---|---|
| 4,339,481 | A * | 7/1982 | Beekhuis | 427/428.1 |
| 4,503,801 | A * | 3/1985 | Collishaw et al. | 118/246 |
| 4,503,802 | A * | 3/1985 | Keller et al. | 118/249 |
| 5,435,848 | A * | 7/1995 | Tanokuchi et al. | 118/688 |
| 6,739,714 | B2 * | 5/2004 | Saijo | 347/96 |
| 6,913,353 | B2 * | 7/2005 | Williams | 347/101 |
| 7,402,209 | B2 * | 7/2008 | Ishida et al. | 118/211 |
| 7,510,610 | B2 * | 3/2009 | Kougami et al. | 118/264 |
| 2011/0157289 | A1 * | 6/2011 | Yamanobe | 347/104 |

FOREIGN PATENT DOCUMENTS

| | | |
|---|---|---|
| JP | 2008-260307 | 10/2008 |
| JP | 2010-158602 | 7/2010 |

* cited by examiner

*Primary Examiner* — Jannelle M Lebron
*Assistant Examiner* — Jeremy Bishop
(74) *Attorney, Agent, or Firm* — Oblon, McClelland, Maier & Neustadt, L.L.P.

(57) ABSTRACT

A treatment liquid application device for use in an inkjet printer includes an application roller to apply a treatment liquid to a recording medium before an image is formed on the recording medium, a squeeze roller disposed below the application roller and to make a pressure-contact with the application roller, a treatment liquid supply unit to supply the treatment liquid to a nip part between the application roller and the squeeze roller, and a pressure roller disposed above the application roller and to cause the recording medium to make a pressure-contact with the application roller. When the application roller applies the treatment liquid to the recording medium, a position of the application roller is not restricted in approximate load directions of the squeeze roller and the pressure roller but is restricted in directions other than the approximate load directions.

9 Claims, 15 Drawing Sheets

TREATMENT LIQUID APPLICATION DEVICE AND IMAGE FORMING SYSTEM

BACKGROUND OF THE INVENTION

1. Field of the Invention

The embodiments discussed herein relate to a treatment liquid application device, and an image forming system including the treatment liquid application device.

2. Description of the Related Art

Inkjet image formation has rapidly become popular owing to its advantages of easy colorization as well as low noise, and low running cost. There are two types of inkjet printers employing such an inkjet system, namely, a serial printer and a line printer. The serial printer is configured to print images by combining an operation to eject ink droplets while moving a recording head in a main-scanning direction (i.e., a recording medium width direction) and an operation to move a target recording medium in a sub-scanning direction. The line printer including a line head having a printing width that equates with a width of the target recording medium, and is configured to print images by relatively moving the line head and the target recording medium.

FIG. 12 is a schematic diagram illustrating a flow of an inkjet image forming system according to an embodiment of the present invention. As illustrated in FIG. 12, a treatment liquid application device 220 is configured to apply a treatment liquid having a function to flocculate ink to a recording medium W before ink droplets drip onto the web (i.e., recording medium) W in order to prevent an image formed on the recording medium W from bleeding, exhibiting degraded density or degraded color tone, or exhibiting strike-through. The treatment liquid application device 220 is configured to apply the treatment liquid on a surface and/or a rear surface of the recording medium W. The treatment liquid application device 220 is employed by the system illustrated in FIG. 12.

A print system 200 includes a sheet feeding device 210, the treatment liquid application device 220, a first inkjet printer 230, an inverting device 240, a second inkjet printer 250, a post-drier device 260, and a rewinder 270. The sheet feeding device 210 is configured to feed the roll sheet recording medium W formed of a long continuous paper or the like to the treatment liquid application device 220 disposed downstream in a recording medium W transfer path.

The treatment liquid application device 220 is configured to apply the treatment liquid to the recording medium W for prevent ink bleeding or ink strike-through appearing on the recording medium W, and to dry the recording medium W to which the treatment liquid has been applied.

FIG. 14 is a schematic configuration diagram illustrating a related art treatment liquid application device previously considered by the inventors of the present invention viewed from a front side, and FIG. 15 is a schematic configuration diagram illustrating the related art treatment liquid application device viewed from a lateral side.

The related art treatment liquid application device includes, as illustrated in FIG. 14, an application roller 1 having a periphery covered with an elastic member such as rubber, a squeeze roller 2 disposed below the application roller 1, and a pressure roller 3 disposed above the application roller 1. The application roller 1, the squeeze roller 2, and the pressure roller 3 are, as illustrated in FIG. 15, disposed in approximately a vertical direction.

The application roller 1 and the squeeze roller 2 are each rotationally driven independently by a not-illustrated driving source such as a motor. As illustrated in FIG. 14, two ends of the application roller 1 are rotationally supported (fixed) on a frame 32 via respective bearings 16.

Further, as illustrated in FIG. 14, squeeze retaining rollers 4 are disposed underneath the squeeze roller 2 along a longitudinal direction of the squeeze roller 2 at approximately regular intervals. The squeeze retaining rollers 4 are rotationally supported inside respective retaining roller holders 8. Respective stick-like holder supporting members 30 are connected to lower parts of the retaining roller holders 8, and washers 31 are disposed one on each middle position and each lower end of a corresponding one of the holder supporting members 30. A slightly compressed coil-like pushup spring 5 is disposed between the washer 31 disposed on the middle position and the washer 31 disposed on the lower end of the holder supporting member 30.

Lower parts of the pushup springs 5 are supported by respective arms 7. A point A of each of the arms 7 serves as a swing center. Each of the arms 7 includes a free end on a side opposite to the point A of the arm 7, and respective squeeze cams 6 are disposed on the free ends of the arms 7. Hence, the free ends of the arms 7 are constantly in contact with the respective squeeze cams 6 by elasticity of the pushup springs 5.

Each arm 7 swings based on the point A serving as a fulcrum point by rotations of the squeeze cam 6, and the swing of the arm 7 compresses the pushup spring 5. The spring load of the pushup spring 5 is transmitted to the corresponding squeeze roller 2 via the holder supporting member 30, the retaining roller holder 8, and the squeeze retaining roller 4. The spring load transmitted to the squeeze roller 2 pushes up the squeeze roller 2 in the application roller 1 direction to finally form a nip part between the squeeze roller 2 and the application roller 1. Note that the rotational angle of the squeeze cam 6 is controlled based on detected signals of a not illustrated rotating position detector such as an encoder.

As illustrated in FIG. 14, the application roller 1 and the squeeze roller 2 are housed inside a supply pan 9. A treatment liquid L is supplied from a tank 10 into the supply pan 9 by a pump 11, such that a part of the squeeze roller 2 is soaked in the treatment liquid L. A liquid level of the treatment liquid L inside the supply pan 9 is monitored by a liquid level detecting sensor 12, and the liquid level inside the tank 10 is retained at a predetermined level by controlling the drive of the pump 11 based on detected signals from the liquid level detecting sensor 12.

The two ends of the pressure roller 3 is rotationally supported on a free end side of the arm 22 that swings based on a D point as the center (see FIG. 15), and the arm 22 is pulled by an extension spring 23 in a counterclockwise direction based on the D point as the center. Further, a cam 25 is disposed on the extension spring 23 side of the arm 22, and the cam 25 is attached to a shaft 24 (see FIG. 14).

Not-illustrated driving source and rotation angle detector are connected to the shaft 24. Hence, a swing angle of the arm 22 is determined by the rotation angle of the shaft 24 (the cam 25), such that the position of the pressure roller 3 with respect to the application roller 1 may be changeable as a result. A web W is inserted between the application roller 1 and the pressure roller 3. When the web W starts being transported by a not-illustrated web transporting mechanism and the speed of the transporting operation reaches a predetermined speed, the pressure roller 3 makes a pressure-contact with the application roller 1 by the arm 22 and the cam 25.

Note that FIGS. 14 and 15 illustrate a standby state before the treatment liquid application device applies a treatment liquid L to the web W. In this state, the application roller 1 and the squeeze roller 2 are not rotated, and the web W is not transported.

The treatment liquid application device is configured to measure the amount of the treatment liquid L when the treatment liquid L is supplied to the nip part between the squeeze roller 2 and the application roller 1. The treatment liquid L passes through the nip part to form a thin treatment liquid layer on a surface of the application roller 1. The thickness (amount) of the treatment liquid layer may be adjusted by load applied by the pushup spring 5. The treatment liquid L is transferred onto the web W by causing the pressure roller 3 to press the web W against the application roller 1, on the surface of which the thin treatment liquid layer is formed.

Note that Japanese Laid-open Patent Publication No. 2010-158602 (Patent Document 1) and Japanese Laid-open Patent Publication No. 2008-260307 (Patent Document 2) may be given as related art technologies associated with the treatment liquid application device.

RELATED ART DOCUMENTS

Patent Document

Patent Document 1: Japanese Laid-open Patent Publication No. 2010-158602

Patent Document 2: Japanese Laid-open Patent Publication No. 2008-260307

It may be difficult to uniformly apply a small amount of the treatment liquid L from three rollers of the application roller 1, the squeeze roller 2, and the pressure roller 3 to the web W, when the three rollers 1, 2, and 3 are deformed due to the load. Hence, in order to suppress such deformation, plural squeeze retaining rollers 4 are disposed to support the squeeze roller 2 in an axial direction of the squeeze roller 2, such that the squeeze retaining rollers 4 are configured to press the squeeze roller 2 on the application roller 1 side.

In addition, not-illustrated plural pressure retaining rollers are disposed to support the pressure roller 3 in an axial direction of the pressure roller 3, such that the pressure retaining rollers are configured to press the pressure roller 3 on the application roller 1 side.

However, as illustrated in FIG. 14, when the two ends of the application roller 1 are fixed to the frame 32 with respective bearings or the like, mismatched loads of the squeeze roller 2 and the pressure roller 3 may be applied to the application roller 1. In such a case, the application roller 1 may be deformed such that non-uniform application of the treatment liquid L may exceed the allowable level. As a result, it may be difficult to exhibit an expected effect of the application of the treatment liquid L to the web W.

More specifically, when loads from the squeeze roller 2 and the pressure roller 3 are applied to the application roller 1 at different timing, the load from the squeeze roller 2 does not necessarily match the load from the pressure roller 3. As a result, mismatched loads to deform the application roller 1 may be applied. When the application roller 1 is deformed, a nip proportion between the squeeze roller 2 and the pressure roller 3 may be degraded to change the amount of the treatment liquid L that passes through the nip part. That is, in the axial direction of the application roller 1, the amount of the treatment liquid L may decrease at a position where the nip load is high whereas the amount of the treatment liquid L may increase at a position where the nip load is low. The above phenomena may occur between the application roller 1 and the pressure roller 3. Such phenomena may result in non-uniform application of the treatment liquid L.

Note that mismatched loads applied from the squeeze roller 2 and the pressure roller 3 to the application roller 1 may result from the difference in the spring force or dimensions of the components.

Further, it is known that the efficiency in transferring the treatment liquid L from the application roller 1 to the web W may be degraded when the web W having inferior absorption of the treatment liquid L is used. In such a case, the untransferred residual treatment liquid L may be accumulated as a result of failing to pass through the nip part between the application roller 1 and the pressure roller 3 via the web W. When the transportation of the web W is stopped in the above state, the accumulated treatment liquid L attached to the web may be in a dripping form. Then, when the transportation of the web W restarts, the attached treatment liquid L in the dripping form may spatter or may be adhere to the not-illustrated other web transporting rollers, which may contaminate the web W every rotational period of the transporting rollers.

SUMMARY OF THE INVENTION

Accordingly, it is a general object in one embodiment of the present invention to provide a novel and useful treatment liquid application device for use in an inkjet printer that is capable of controlling non-uniform application of the treatment liquid, and capable of exhibiting desired effects of the applied treatment liquid.

According to one aspect of the embodiment, there is provided a treatment liquid application device for use in an inkjet printer. The treatment liquid application device includes an application roller configured to apply a treatment liquid to a recording medium before an image is formed on the recording medium; a squeeze roller disposed below the application roller and configured to make a pressure-contact with the application roller; a treatment liquid supply unit configured to supply the treatment liquid to a nip part between the application roller and the squeeze roller; and a pressure roller disposed above the application roller and configured to cause the recording medium to make a pressure-contact with the application roller. In the treatment liquid application device, the squeeze roller and the pressure roller are configured to apply respective loads to the application roller, and when the application roller applies the treatment liquid to the recording medium, a position of the application roller is not restricted in approximate load directions of the squeeze roller and the pressure roller, and the position of the application is restricted in directions other than the approximate load directions.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DETAILED DESCRIPTION OF THE PREFERRED EMBODIMENTS

The embodiments provide a treatment liquid device for use in an inkjet printer, and an image forming apparatus such as the inkjet printer including the treatment liquid device. The treatment liquid device is configured to apply a treatment liquid such as a bleeding control agent to control bleeding of images printed on the recording medium. Such a treatment liquid is generally applied to the recording medium before the images are printed.

Figure 12:
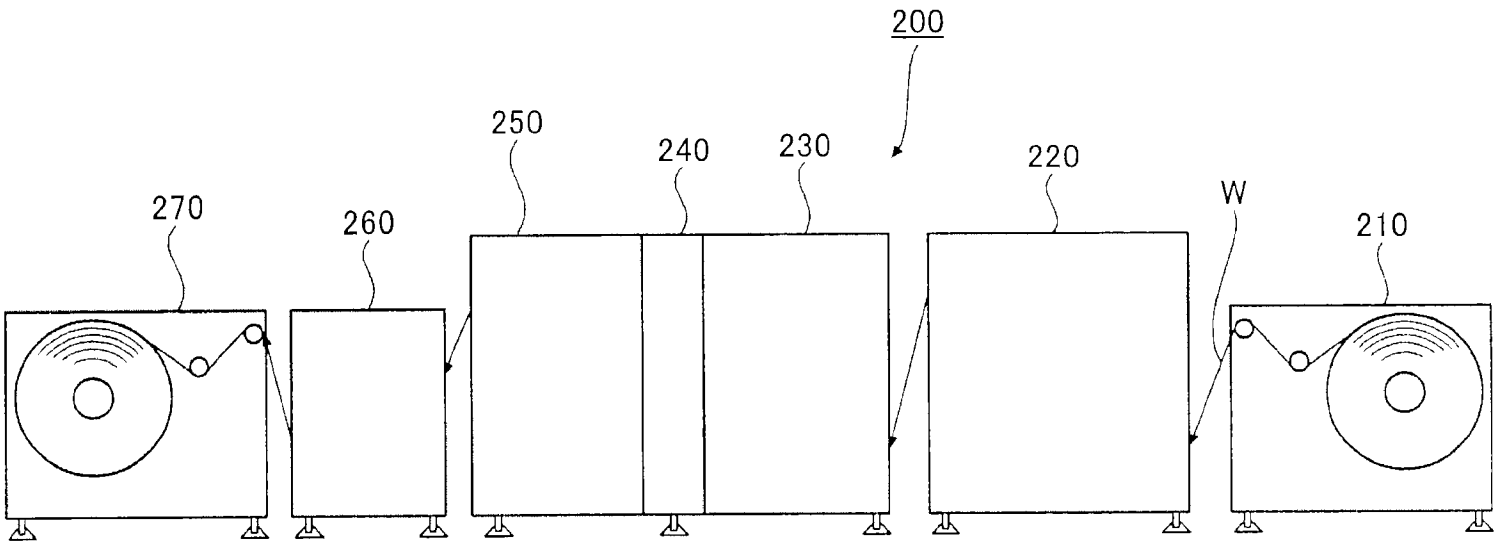
FIG. 12 is a flowchart illustrating an image forming system including a treatment liquid application device and an inkjet printer that are sequentially disposed.

In the following, preferred embodiments of the present invention will be described with reference to the accompanying drawings. A description is given of an overall image forming system according to an embodiment. FIG. 12 is a schematic configuration diagram of a treatment liquid application device 220 for use in the image forming system illustrating a state in which the treatment liquid is applied.

The treatment liquid application device 220 is configured to apply a treatment liquid to a recording medium W for improving a quality of an image by preventing the ink from bleeding or improving ink permeability. The treatment liquid application device 220 is configured to apply the treatment liquid on a surface and/or a rear surface of the recording medium W. The treatment liquid application device 220 is employed by the system illustrated in FIG. 12. A print system 200 includes a sheet feeding device 210, a treatment liquid application device 220, a first inkjet printer 230, an inverting device 240, a second inkjet printer 250, a post-drier device 260, and a rewinder 270.

The sheet feeding device 210 is configured to feed the recording medium W of a roll sheet formed of a long continuous paper or the like to the treatment liquid application device 220 disposed downstream in a recording medium W transfer path.

The treatment liquid application device 220 is configured to apply the treatment liquid to the recording medium W for suppressing ink bleeding or ink strike-through appearing on the recording medium W, and to dry the recording medium W to which the treatment liquid has been applied.

The first inkjet printer 230 is configured to form a desired image by ejecting ink droplets onto a surface of the recording medium W to which the treatment liquid is applied by the treatment liquid application device 220.

The inverting device 240 includes a not-illustrated drier, and is configured to dry the image formed by the first inkjet printer 230 on the surface of the recording medium W and then invert the surface into the rear surface of the recording medium W. The second inkjet printer 250 is configured to form a desired image by ejecting ink droplets onto the rear surface of the recording medium W inverted by the inverting device 240.

The post-drier device 260 is configured to dry the images formed on the surface and rear surface of the recording medium W with hot air blasted by a not-illustrated drier. The rewinder 270 is configured to wind the dried recording medium W.

Figure 13:
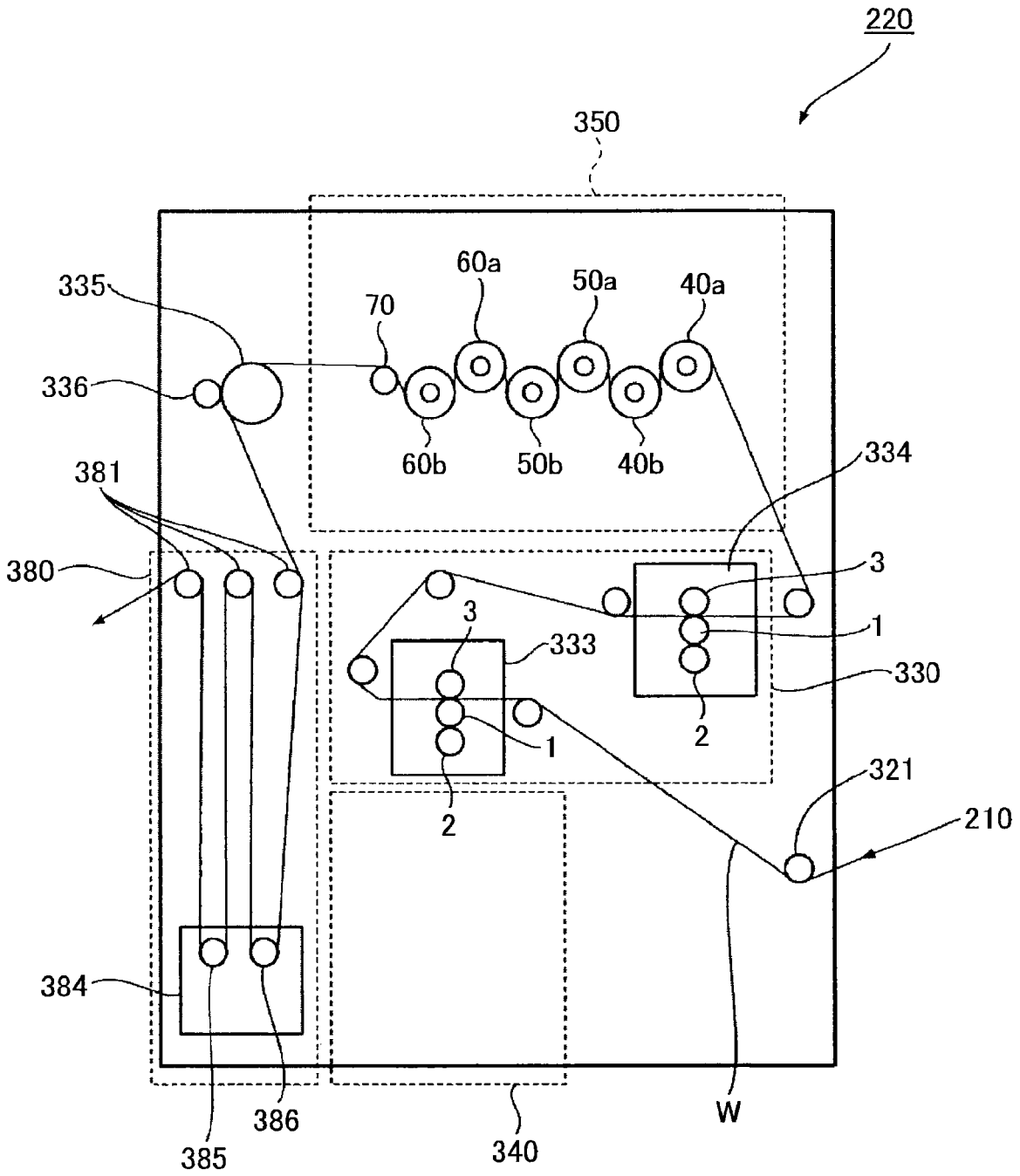
FIG. 13 is a schematic diagram illustrating an overall configuration of the treatment liquid application device.
Figure 14:
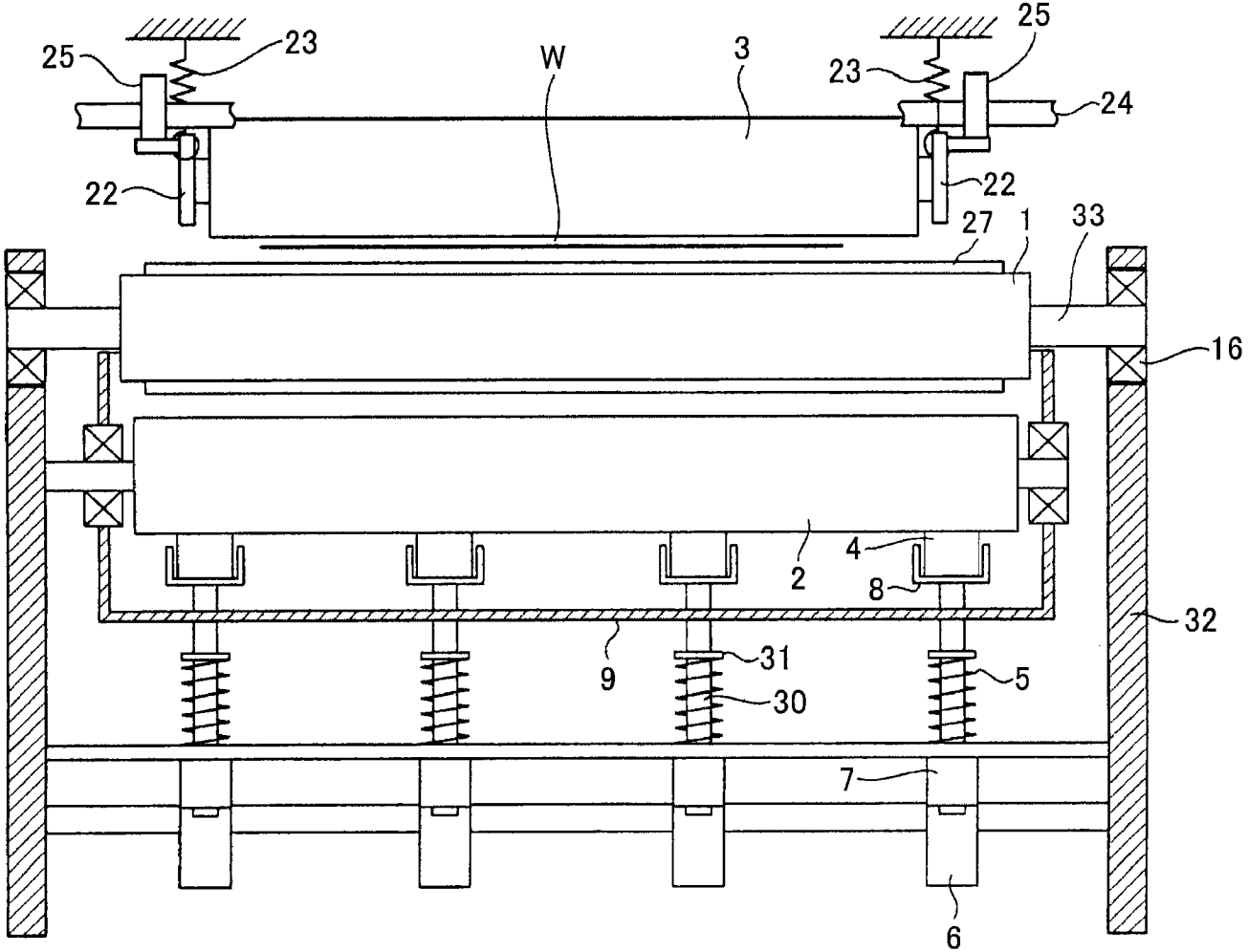
FIG. 14 is a schematic configuration diagram illustrating a related art treatment liquid application device previously considered by the inventors of the present invention.
Figure 15:
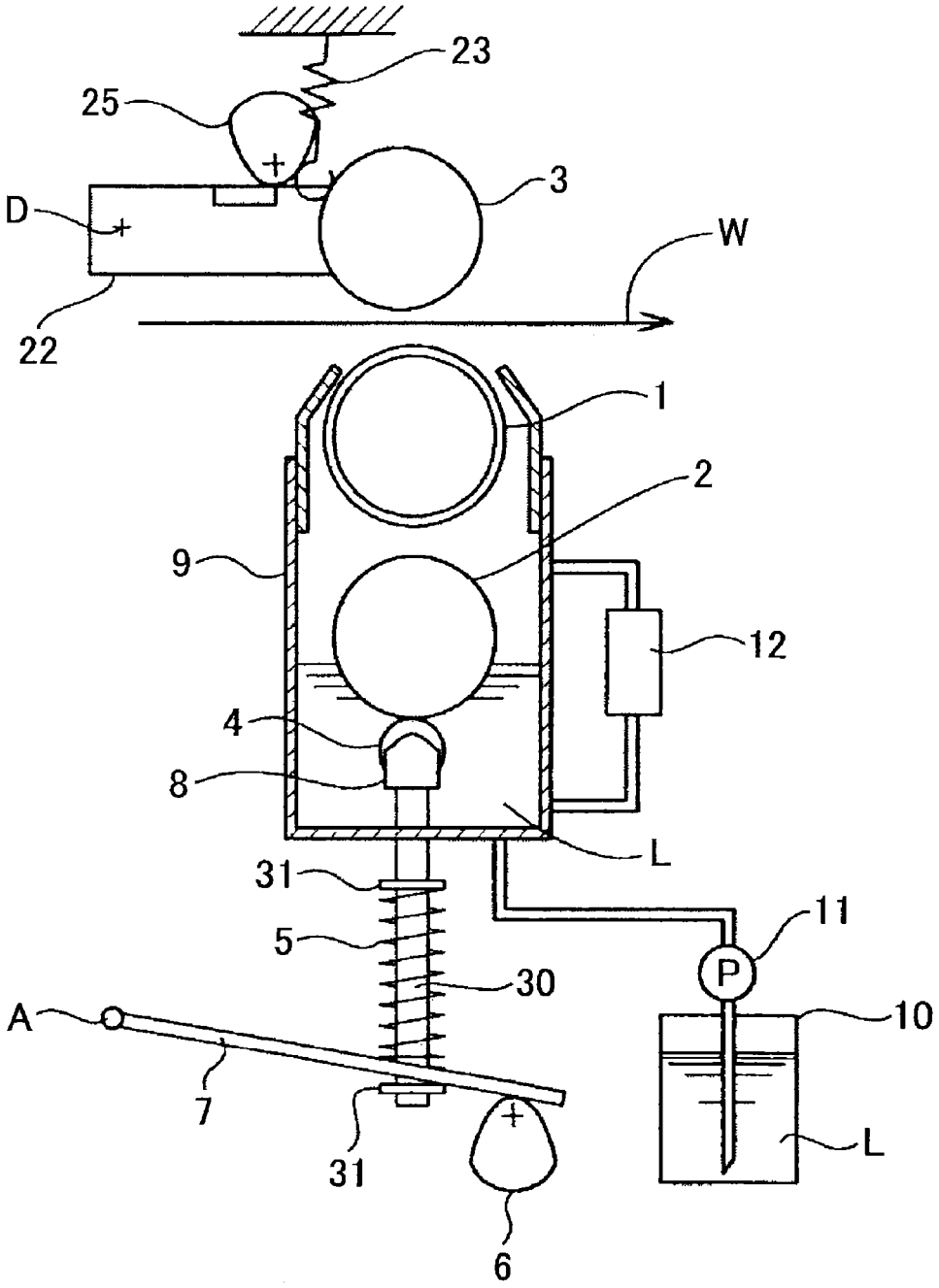
FIG. 15 is a schematic configuration diagram illustrating the treatment liquid application device in view of a lateral side.

Next, illustration is given in FIG. 13 of an overall configuration of the treatment liquid application device 220. The treatment liquid application device 220 includes a treatment liquid application unit 330, a supply unit 340, a drier unit 350, and a dancer unit 380.

The sheet feeding device 210 is configured to apply appropriate tension to the recording medium W that is transported via a guide roller 321 from the sheet feeding device 210.

The treatment liquid is applied to a rear surface (one of the sides) of the recording medium W that is transported by an outfeed roller 335 by a rear surface application unit 333 including a squeeze roller 2, an application roller 1 and a pressure roller 3. The treatment liquid is then applied to a surface (the other side) of the recording medium W that has passed through the rear surface application unit 333 by a surface application unit 334 including a squeeze roller 2, an application roller 1 and a pressure roller 3. The recording medium W that has passed through the surface application unit 334 is transported by the rotationally driving outfeed roller 335 and feed-nip roller 336 to the drier unit 350. Note that one of the rear surface application unit 333 and the surface application unit 334 is selectively activated to apply the treatment liquid to a corresponding one of the surface and the rear surface of the recording medium W or both the surface and the rear surface of the recording medium W.

The supply unit 340 is configured to accumulate the treatment liquid to constantly supply the treatment liquid to the rear surface application unit 333 and the surface application unit 334.

The drier unit 350 includes a first-stage heating roller set 40 having a first-stage rear surface heating roller 40*a* and a first-stage surface heating roller 40*b*, a second-stage heating roller set 50 having a second-stage rear surface heating roller 50*a* and a second-stage surface heating roller 50*b*, a third-stage heating roller set 60 having a third-stage rear surface heating roller 60*a* and a third-stage surface heating roller 60*b*, and an eject conveying roller 70.

The first-stage heating roller set 40, the second-stage heating roller set 50, and the third-stage heating roller set 60 are disposed such that the first-stage heating roller set 40, the second-stage heating roller set 50, and the third-stage heating roller set 60 are aligned from upstream to downstream of a web W transporting direction. Each of the heating rollers 40*a*, 40*b*, 50*a*, 50*b*, 60*a*, and 60*b* (hereinafter simply called "heating rollers 40*a* to 60*b*") is rotationally supported by bearings disposed on two ends in a longitudinal direction of a corresponding one of the heating rollers 40*a* to 60*b*.

The first-stage rear surface heating roller 40*a* and the first-stage surface heating roller 40*b*, the second-stage rear surface heating roller 50*a* and the second-stage surface heating roller 50*b*, and the third-stage rear surface heating roller 60*a* and the third-stage surface heating roller 60*b* are separately disposed from each other in a staggered arrangement. For example, a line connecting respective rotation centers of the first-stage rear surface heating roller 40*a*, the second-stage rear surface heating roller 50*a* and the third-stage rear surface heating roller 60*a* is separately disposed from and in parallel with a line connecting respective rotation centers of the first-stage surface heating roller 40*b*, the second-stage surface heating roller 50*b* and the third-stage surface heating roller 60*b*.

Further, the rotationally driven feed roller 335 and the feed-nip roller 336 configured to elastically sandwich the recording medium W with the feed roller 335 are disposed outside the drier unit 350. The recording medium W transported outside the drier unit 350 passes through an interval between the feed roller 335 and the feed-nip roller 336 and is then transported to the dancer unit 380.

The dancer unit 380 includes three guide rollers 381, a movable frame 384 having not-illustrated weights and configured to be movable in a gravity direction, a not-illustrated position detector configured to detect a position of the movable frame 384, and two dancer rollers 385 and 386 rotationally attached to the movable frame 384. The recording medium W is wound in a W-form fashion by the three guide rollers 381 and the two dancer rollers 385 and 386.

The dancer unit 380 is configured to control the rotational drive of the feed roller 335 based on an output of the not-illustrated position detector so as to adjust upward and downward directions of the movable frame 384. Hence, the buffer amount of the recording medium W between the treatment liquid application device 220 and the first inkjet printer 230 may be acquired.

Next, illustration is given of a configuration of the treatment liquid application device 220 according to first to third embodiments.

First Embodiment

Figure 1:
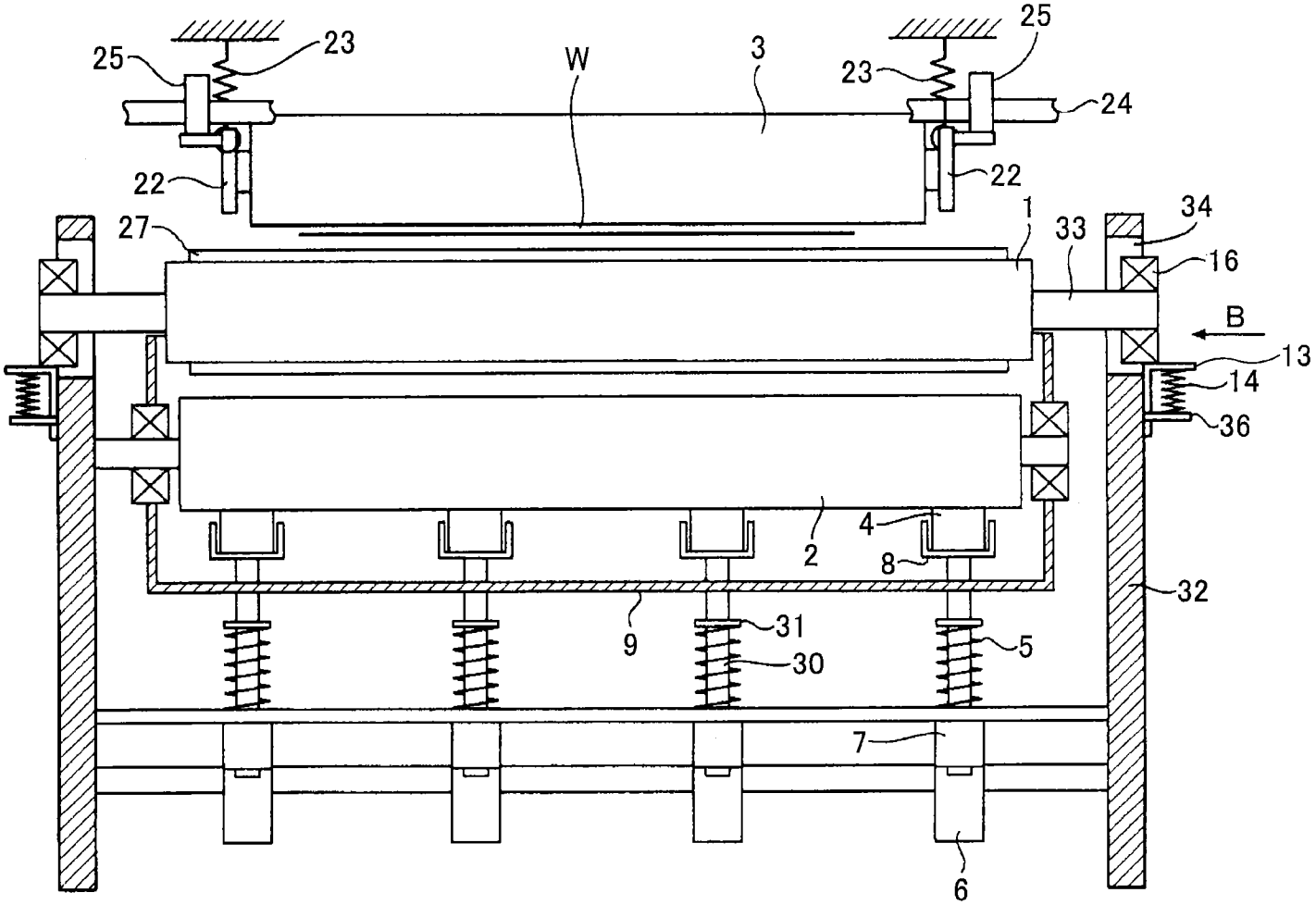
FIG. 1 a schematic configuration diagram illustrating a treatment liquid application device according to a first embodiment viewed from a front side.
Figure 2:
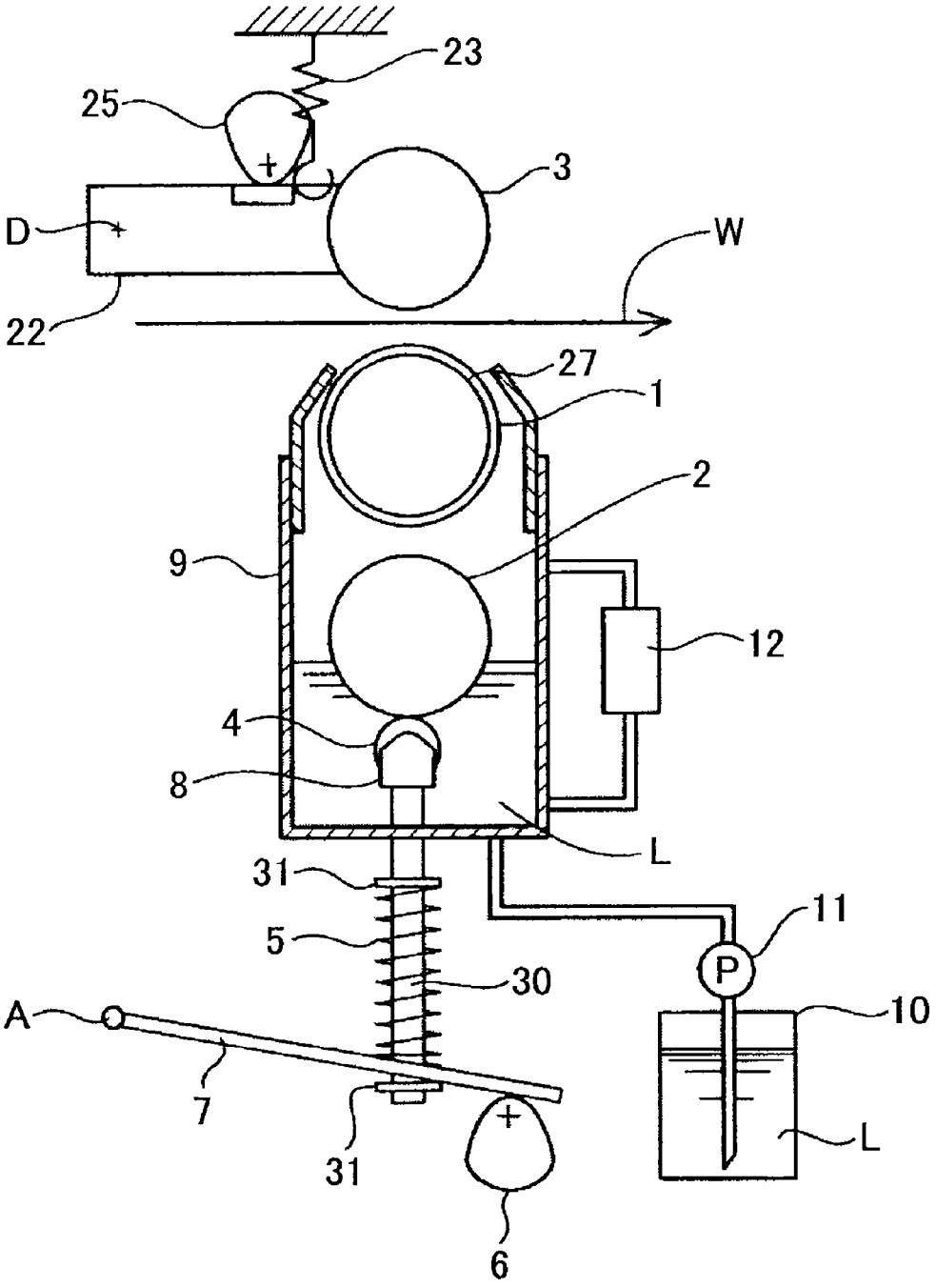
FIG. 2 is a schematic configuration diagram illustrating the treatment liquid application device viewed from a lateral side.

FIG. 1 is a schematic configuration diagram illustrating a treatment liquid application device according to the first embodiment viewed from a front side, and FIG. 2 is a schematic configuration diagram illustrating the treatment liquid application device viewed from a lateral side. Note that FIGS. 1 and 2 each illustrate the treatment liquid application device in a standby state before a treatment liquid L is applied.

The treatment liquid application device according to the first embodiment includes, as illustrated in FIGS. 1 and 2, an application roller 1 having a periphery covered with an elastic member such as rubber, a squeeze roller 2 disposed below the application roller 1, and a pressure roller 3 disposed above the application roller 1. The application roller 1, the squeeze roller 2, and the pressure roller 3 are, as illustrated in FIG. 2, disposed in an approximately vertical direction.

When the squeeze roller 2 or the pressure roller 3 makes a pressure-contact with the application roller 1 while the application roller 1 is not rotated, the elastic member 27 may be slightly deformed, which may cause non-uniform application of the treatment liquid L. Hence, as illustrated in FIGS. 1 and 2, the squeeze roller 2 and the pressure roller 3 are configured to be separated from the application roller 1 so as not to be in contact with the application roller 1.

Plural squeeze retaining rollers 4 are disposed underneath the squeeze roller 2 along a longitudinal direction of the squeeze roller 2 at approximately regular intervals. The squeeze retaining rollers 4 are rotationally supported inside respective retaining roller holders 8. Respective holder supporting members 30 are connected to lower parts of the retaining roller holders 8, and a coil-like pushup spring 5 is disposed in a slightly compressed state between washers 31 disposed on each of the holder supporting members 30.

Respective lower parts of the pushup springs 5 are supported by arms 7, and squeeze cams 6 are disposed on respective free ends of the arms 7. Each of the arms 7 swings by the rotation of the squeeze cam 6 based on a point A to serve as the center to further compress the pushup spring 5. This results in pushing up the squeeze roller 2 in the application roller 1 direction to form a nip part between the squeeze roller 2 and the application roller 1.

Note that the squeeze roller 2 is rotationally attached to a side frame of a supply pan 9. Since the supply pan 9 is swingably supported on the center of a frame of a body of the treatment liquid application device (not illustrated), the squeeze roller 2 is lifted together with the supply pan 9 so as to come in contact with the application roller 1.

The treatment liquid L is supplied by a pump 11 from a tank 10 into the supply pan 9, such that a part of the squeeze roller 2 is soaked in the treatment liquid L. Even when the squeeze roller is lifted toward the application roller 1 side, the part of the squeeze roller 2 is soaked in the treatment liquid L.

As illustrated in FIG. 2, the two ends of the pressure roller 3 are rotationally supported on the free end side of the arm 22, and the arm 22 is pulled in a counterclockwise direction by the extension spring 23 based on a point D as the center. Further, the cam 25 is disposed on the extension spring 23 side of the arm 22, and the cam 25 is attached to the shaft 24 (see FIG. 1).

The web W is inserted between the application roller 1 and the pressure roller 3. When a not-illustrated web transporting mechanism starts a transporting operation to transport the web W and the speed of the transporting operation reaches a predetermined speed, the pressure roller 3 makes a pressure-contact with the application roller by the arm 22 and the cam 25.

In this configuration, the treatment liquid L is supplied to the nip part between the rotating application roller 1 and the squeeze roller 2 so as to measure the amount of the treatment liquid L. The treatment liquid L passes through the nip part to form a thin treatment liquid layer on the surface of the application roller 1. The amount of the treatment liquid may be adjusted by the generated load of the pushup spring 5 or a rotational angle of the squeeze cam 6. By allowing the pressure roller 3 to press the web W to the application roller 1 on the surface of which the thin treatment liquid layer is formed, the treatment liquid L is transferred and applied to the web W.

FIGS. 3A to 3D are partial diagrams illustrating respective states of the treatment liquid application device viewed from a direction B of FIG. 1, and FIGS. 4A to 4D are partial diagrams illustrating outlined positional relationships between the application roller 1, the squeeze roller 2, and the pressure roller 3 in respective states (contact or noncontact sates of the rollers 1, 2, and 3) of the treatment liquid application device illustrated in FIGS. 3A to 3D.

As illustrated in FIGS. 1 and 3A to 3D, respective bearings 16 are attached to external ends of the rotational shaft 33 projected from the two end surfaces of the application roller 1. On the other hand, the frame 32 includes elongated holes 34 extending in an approximately vertical direction (approximate load imposed direction) formed at respective positions of the bearings 16 of the frame 32.

The longitudinal diameter (a diameter in a vertical direction) of the elongated hole 34 is designed to be far longer than an outer diameter of the bearing 16, whereas the short diameter (a diameter in a direction orthogonal to the vertical direction) is designed to be approximately the same dimension as the outer diameter of the bearing 16, which enables the bearings 16 to be slidably inserted in the respective elongated holes 34. Hence, the application roller 1 may be able to move in an approximately vertical direction (approximate load imposed direction) without any restrictions but to have a restriction on the movement in a horizontal direction.

Note that in the first embodiment, the elongated holes 34 are formed in the frame 32. However, the elongated holes 34 may be formed in a fixed member other than the frame 32 so as to displaceably support the bearings 16 in the elongated holes 34 in load imposed directions of the application roller 1 and the squeeze roller 2, and the pressure roller 3.

The outer ends of the bearings 16 are outwardly projected from lateral sides of the frame 32, and each application roller arm 13 having a lateral side shape of an inverted L (see FIG. 1) is disposed on its side beneath the projected part of the bearing 16 (see FIGS. 3A to 3D). A supporting pin 35 is inserted in a base end of the application roller arm 13, such that the application roller arm 13 is swingably supported with respect to the frame 32.

On the other hand, a spring bearing 36 is projected from the frame 32 below a free end of the application roller arm 13 disposed opposite to the base end of the application roller arm 13. A coil-like lifting spring 14 is disposed between the spring bearing 36 and the application roller arm 13 having an inverted L shape. Further, a stopper pin 15 (see FIGS. 3A to 3D) projected from the frame 32 is disposed at a predetermined position above the lifting spring 14.

Note that a supporting mechanism for the application roller 1 that includes the application roller arm 13, the lifting spring 14, the stopper pin 15, the bearing 16, the elongated hole 34, and the spring bearing 36 is disposed on the two ends of the application roller 1, as illustrated in FIG. 1.

Figure 3C:
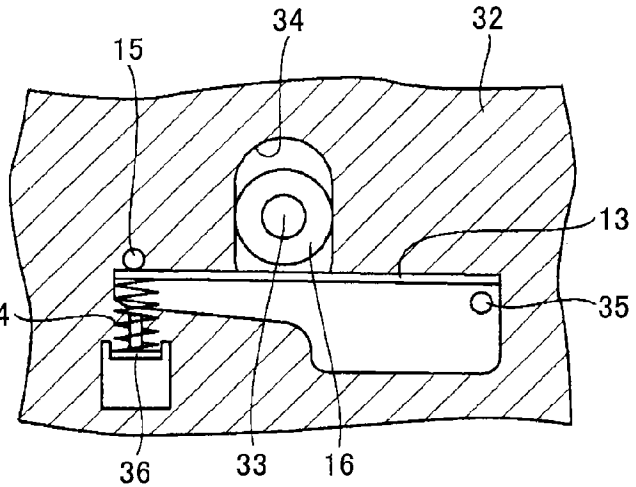
FIGS. 3A to 3D are partial diagrams illustrating respective states of the treatment liquid application device viewed from a direction B of FIG. 1.
Figure 3D:
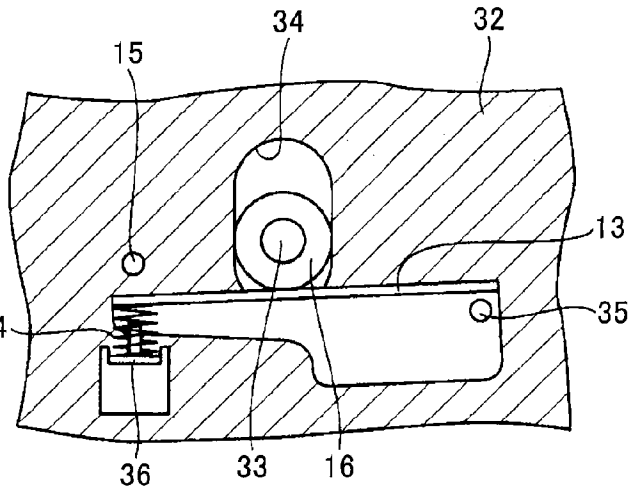
Figure 3A:
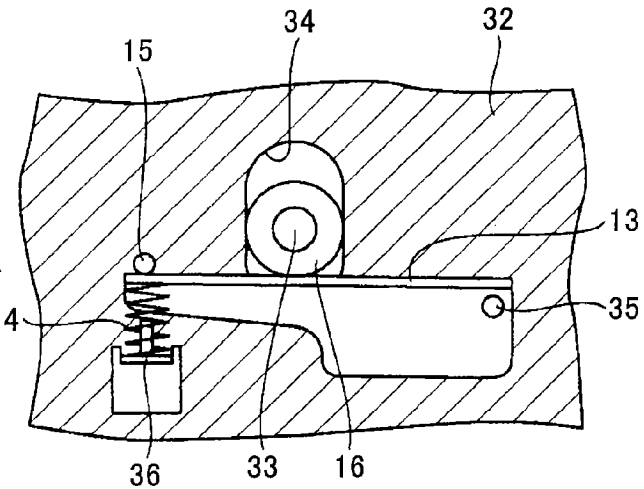
Figure 3B:
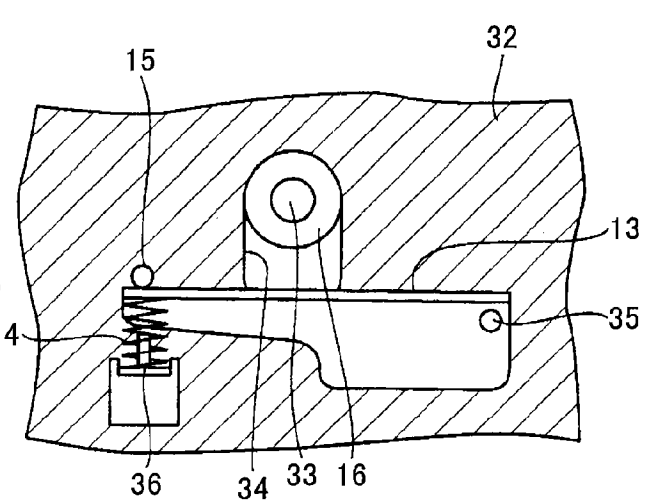
Figure 4A:
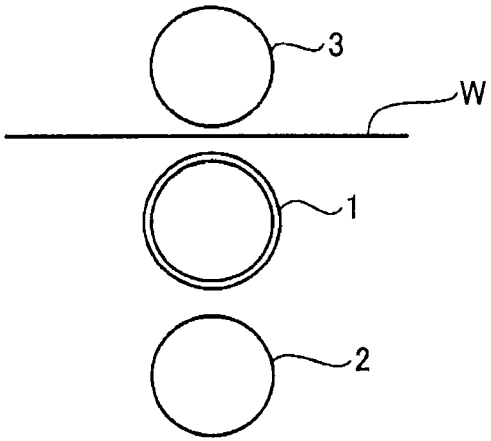
FIGS. 4A to 4D are partial diagrams illustrating positional relationships between an application roller, a squeeze roller, and a pressure roller in respective states of the treatment liquid application device illustrated in FIGS. 3A to 3D.
Figure 4B:
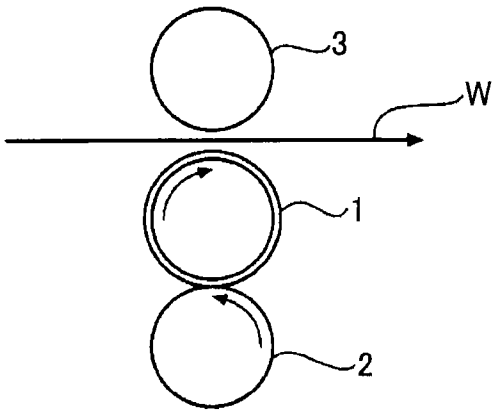
Figure 4C:
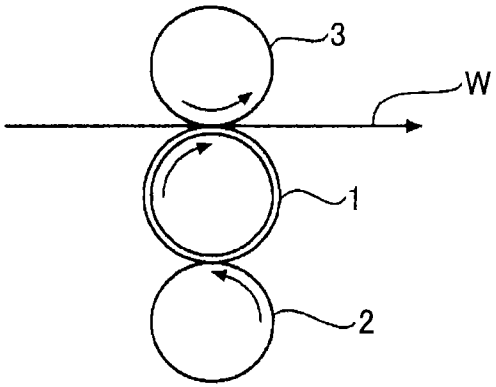
Figure 4D:
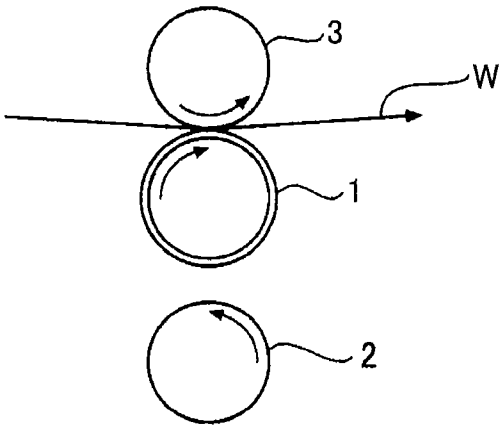
Figure 5:
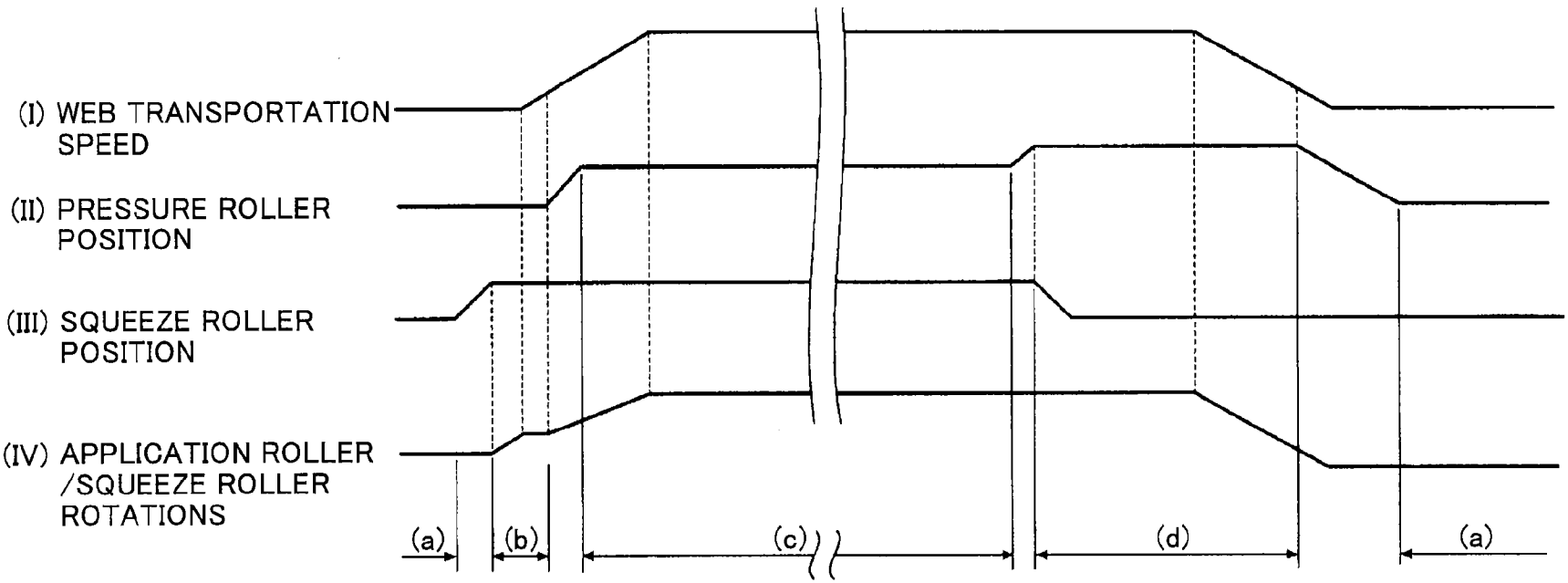
FIG. 5 is a timing chart illustrating an internal mechanical operation of the treatment liquid application device.

Next, illustration is given, with reference to FIG. 3A to FIG. 5, of an application operation to apply the treatment liquid L. FIGS. 3A to 3D and FIGS. 4A to 4D illustrate states at the same timing. FIG. 5 illustrates a change in (I) the web W transportation speed, a change in (II) the pressure roller 3 position, a change in (III) the squeeze roller position, and changes in (IV) the application roller and squeeze roller rotations. Note that respective intervals (a) to (d) illustrated in FIG. 5 indicate the states in FIGS. 3A to 3D, and the states in FIGS. 4A to 4D.

Note that FIGS. 3A and 4A each illustrate a standby state before the treatment liquid L is applied. As illustrated in FIG. 3A, the application roller 1 is disposed with its own weight on the application roller arms 13, and the free end of each application roller arm 13 is lifted at a position where the free end of the application roller arm 13 is brought into contact with the stopper pin 15 by elasticity of the lifting spring 14. Each bearing 16 is disposed at approximately a center of a longitudinal direction of the elongated hole 34.

Hence, as illustrated in FIG. 4A, the squeeze roller 2 is disposed beneath the application roller 1 such that the squeeze roller 2 is not in contact with the application roller 1, and the application roller 1, the squeeze roller 2, and the pressure roller 3 are separated from one another. The overall treatment liquid application device in the above state is depicted by FIGS. 1 and 2.

Hence, in the standby state, (I) the transportation of the web W is stopped, (II) the pressure roller 3 is disposed at a higher position, (III) the squeeze roller 2 is disposed at a lower position, and (IV) rotations of the application roller 1 and the squeeze roller 2 are stopped, as illustrated in FIG. 5.

The squeeze cam 6 (see FIG. 2) rotates before the transportation of the web W, and the squeeze roller 2 is lifted in the application roller 1 direction via the pushup spring 5 (see (III) in FIG. 5) to make a pressure-contact with the application roller 1, thereby lift the application roller 1. As illustrated in FIG. 3B, the bearing is stopped at a position where the bearing 16 reaches an uppermost part of the elongated hole 34 so as to restrict the movement of the application roller 1 in a further upward direction by the elongated hole 34.

The application roller 1 is moved in the upward direction as described above. However, since the application roller arm 13 is stopped by the stopper pin 15, the application roller arm 13 is in a state similar to that illustrated in FIG. 3A.

The squeeze roller 2 and the application roller 1 are, after having been in a state illustrated in FIG. 4B, rotated in mutually opposite directions at a low speed by a not illustrated driving source (see (IV) of FIG. 5). The web W starts being transported when the rotations of the squeeze roller 2 and the application roller 1 are stabilized (see (I) of FIG. 5). The pressure roller 3 starts being pressed on the application roller 1 when the speeds of the rotations of the squeeze roller 2 and the application roller 1 reach the speeds at which the application of the treatment liquid L is secured (see (II) of FIG. 5). The transportation of the web W and the application roller 1 are controlled such that the transportation speed of the web W matches the circumferential speed of the application roller 1.

FIGS. 3C and 4C illustrate states in which the pressure roller 3 pushes the application roller 1 in a predetermined amount. When the pressure roller 3 pushes the application roller 1 in the predetermined amount, the bearing 16 is not in contact with and separated from the application roller arm 13 and the uppermost part of the elongate hole 34 as illustrated in FIG. 3C. Further, the position of the application roller 1 is not restricted (fixed) with respect to the approximate load imposing directions including the load imposing directions of the pressure roller 3 and the squeeze roller 2, such that the position of the application roller 1 is determined based on a corresponding one of the squeeze roller 2 and the pressure roller 3.

The treatment liquid L inside the supply pan 9 is scooped by the squeeze roller 2, and the amount of the scooped treatment liquid L is controlled (restricted) by the nip part between the squeeze roller 2 and the application roller 1 to form a thin treatment liquid L layer on the surface of the application roller 1. When the thin treatment liquid L layer formed on the surface of the application roller 1 is brought into contact with the web W, the treatment liquid L is applied by being transferred to and absorbed into the web W.

Before the transportation of the web W is stopped, the pressure roller 3 further presses the application roller 1 to be in a state illustrated in FIG. 3D. In this state, the application roller arm 13 swings in a downward direction based on the supporting pin 35 as the center such that the free end of the application roller arm 13 separates from the stopper pin 15. Further, in this state, the squeeze cam 6 (see FIG. 2) is rotated such that the squeeze roller 2 separates from the application roller 1 (see (III) of FIG. 5, and FIG. 4D) to stop supply of the treatment liquid L to the application roller 1.

When the transportation of the web W is stopped by decelerating the transportation speed, the rotations of the application roller 1 and the squeeze roller 2 may be stopped (see (I) and (IV) of FIG. 5). When the transportation speed of the web W is equal to or lower than a predetermined speed, the pressure roller 3 is moved in a separating direction from the application roller 1 (see (II) of FIG. 5) to restore the states illustrated in FIGS. 3A and 4A for next treatment liquid L application.

Second Embodiment

Figure 6:
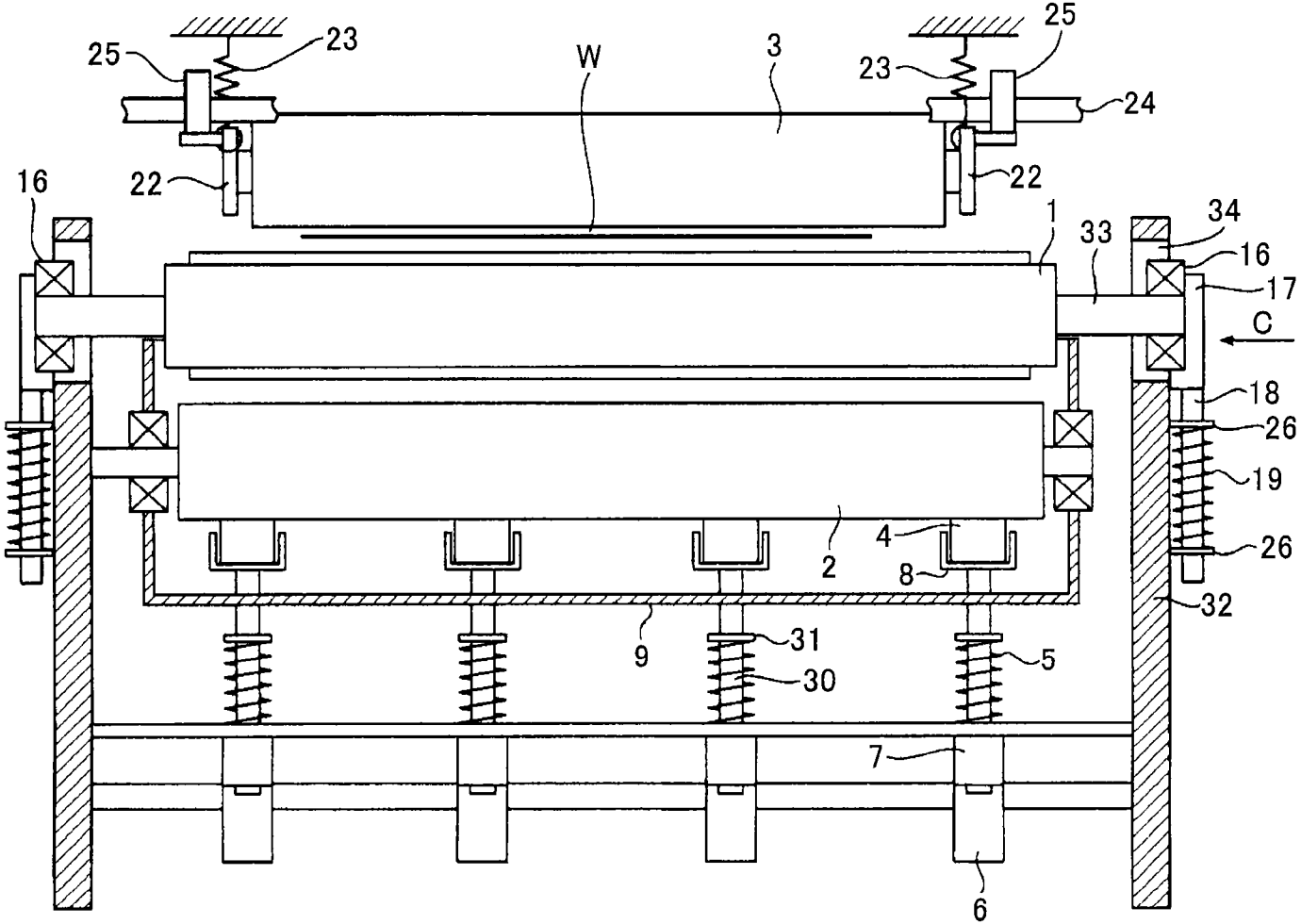
FIG. 6 is a schematic configuration diagram illustrating a treatment liquid application device according to a second embodiment viewed from a front side.
Figure 7:
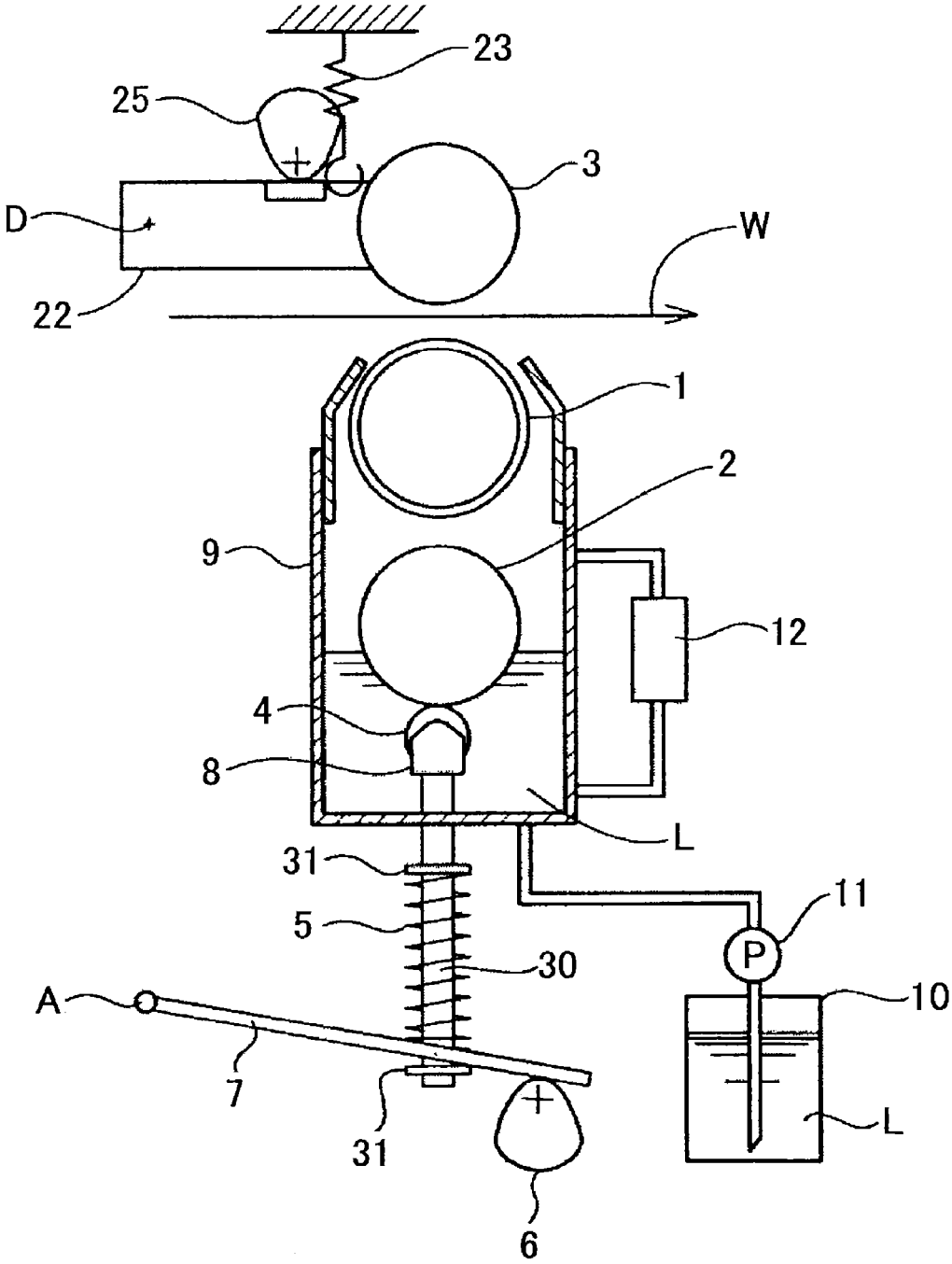
FIG. 7 is a schematic configuration diagram illustrating the treatment liquid application device viewed from a lateral side.
Figure 8:
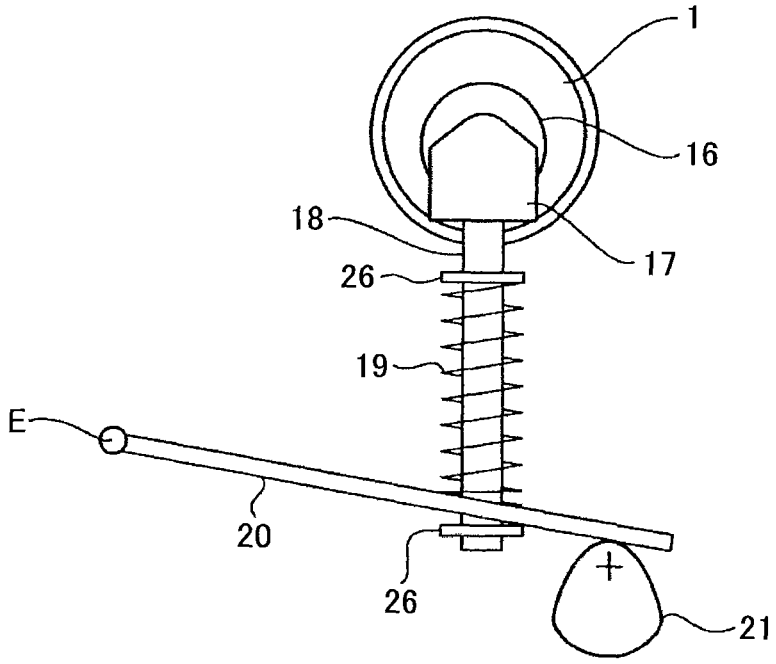
FIG. 8 is a partial diagram illustrating the treatment liquid application device viewed from a direction C of FIG. 6.

FIG. 6 is a schematic configuration diagram illustrating the treatment liquid application device according to a second embodiment viewed from a front side, and FIG. 7 is a schematic configuration diagram illustrating the treatment liquid application device viewed from a lateral side. FIGS. 6 and 7 both illustrate a standby state of the treatment liquid application device before the treatment liquid L is applied. FIG. 8 is a partial diagram illustrating the treatment liquid application device viewed from a direction C of FIG. 6.

In the treatment liquid application device according to the second embodiment, bearings 16 disposed on two ends of the application roller 1 are attached to bearing holders 17 (see FIG. 8), and stick-like holder supporting members 18 are connected to respective lower parts of the bearing holders 17. Washers 26 are disposed one at a middle position and one at a lower end part of each holder supporting member 18, a coil-like lifting spring 19 in a slightly compressed state is disposed between the two washers 26 on each holder supporting member 18.

As illustrated in FIG. 8, a lower part of the pushup spring 19 is supported by an arm 20. A point E of the arm 20 serves as a swing center. The arm 20 includes a free end on a side opposite to the point E of the arm 20, and a squeeze cam 21 is disposed on the free end of the arm 20. Hence, the free end of the arm 20 is constantly in contact with the squeeze cam 21 by elasticity of the pushup spring 19.

The rotational driving of the application roller cam 21 is performed by a not-illustrated driving source such as a motor, the rotational angle of the application roller cam 21 may be controlled based on detected signals of a not-illustrated rotational angle detector such as an encoder. When the arm 20 swings by the rotation of the application roller cam 21 based on a point E as a fulcrum, the arm 20 compresses the pushup spring 19. Hence, the load of the pushup spring 19 transmitted to the application roller 1 via the holder supporting member 18, the bearing holder 17, and the bearing 16. In this case, force of the pushup spring 19 is determined based on a swing rotational angle of the arm 20, the swing rotational angle of the arm 20 is determined based on a rotational angle of the application roller cam 21.

The pushup spring 19, the arm 20, and the application roller cam 21 are maintained in the state illustrated in FIG. 8 while the treatment liquid L is applied by the transportation of the web W.

With the above-described configuration, the application roller cam 21 may be rotated when the transportation of the web W is stopped. Further, after the application roller 1 is operated to press in the pressure roller 3 direction, the squeeze roller 2 may be separated from the application roller 1 by the rotation of the squeeze cam 6 (see FIG. 7) to stop supplying the treatment liquid L to the application roller 1.

Figure 9:
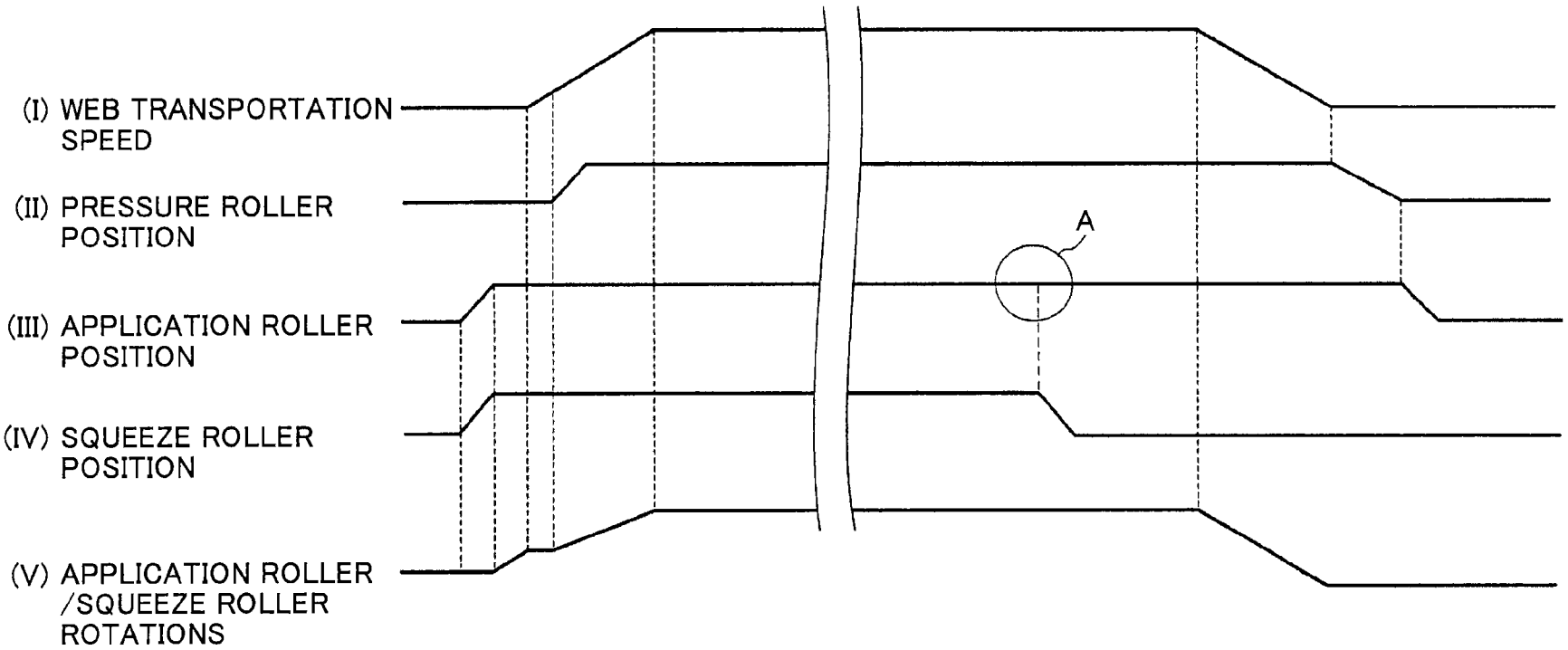
FIG. 9 is a timing chart illustrating an internal mechanical operation of the treatment liquid application device.

Next, an operation of the above mechanical part is illustrated with reference to FIG. 9. FIG. 9 illustrates a change in (I) the web W transportation speed, a change in (II) the pressure roller 3 position, a change in (III) the application roller 1 position, changes in (IV) the squeeze roller 2 position, and a change in (V) the application roller 1/the squeeze roller 2 rotations.

The squeeze roller 2 and the application roller 1 start rotating before the web W starts being transported and after the nip part is formed between the squeeze roller 2 and the application roller 1 so as to prepare the application of the treatment liquid L.

The pressure roller 3 is then moved on the application roller 1 side to press the application roller 1. The treatment liquid L starts being applied to the web W when the web W is pressed on the application roller 1 by the pressure roller 3 at a time where the circumferential speed of the application roller 1 matches the transportation speed of the web W.

On the other hand, when the treatment liquid L stops being applied, the application roller cam 21 is rotated from the state illustrated in FIG. 8, and the application roller 1 is operated separately to press the pressure roller 3 so as to prevent the application roller 1 from separating from the pressure roller 3. After the above operations are completed, the squeeze cam 6 is rotated until the squeeze cam 6 is in the state of FIG. 7 to separate the squeeze roller 2 from the application roller 1. Hence, the treatment liquid L stops being supplied from the squeeze roller 2 to the application roller 1.

At a point A in FIG. 9, even when the squeeze roller 2 is lowered with the rotation of the squeeze cam 6, the application roller 1 is maintained at a higher position by the rotation of the application roller cam 21. That is, the point A indicates a time at which the application roller 1 starts separating from the squeeze roller 2.

Note that the treatment liquid L accumulated between the application roller 1 and the pressure roller 3 via the web W is transferred to and absorbed into the web W to be thinly applied to the web W by the transportation of the web W. Hence, the treatment liquid L will not be attached to the web W in a dripping form, which may eliminate adverse effects due to application of the treatment liquid L.

Thereafter, as illustrated in (I) and (V) of FIG. 9, the transportation speed of the web W starts decelerating, and the rotational speeds of the application roller 1 and the squeeze roller 2 decelerate simultaneously with the deceleration of the web W transportation. The pressure roller 3 is separated from the application roller 1 simultaneously when the transportation of the web W is stopped. The application roller cam 21 is rotated when the separating operation is completed to transition the application roller 1 in an initial state for a next treatment liquid L application.

Third Embodiment

Figure 10:
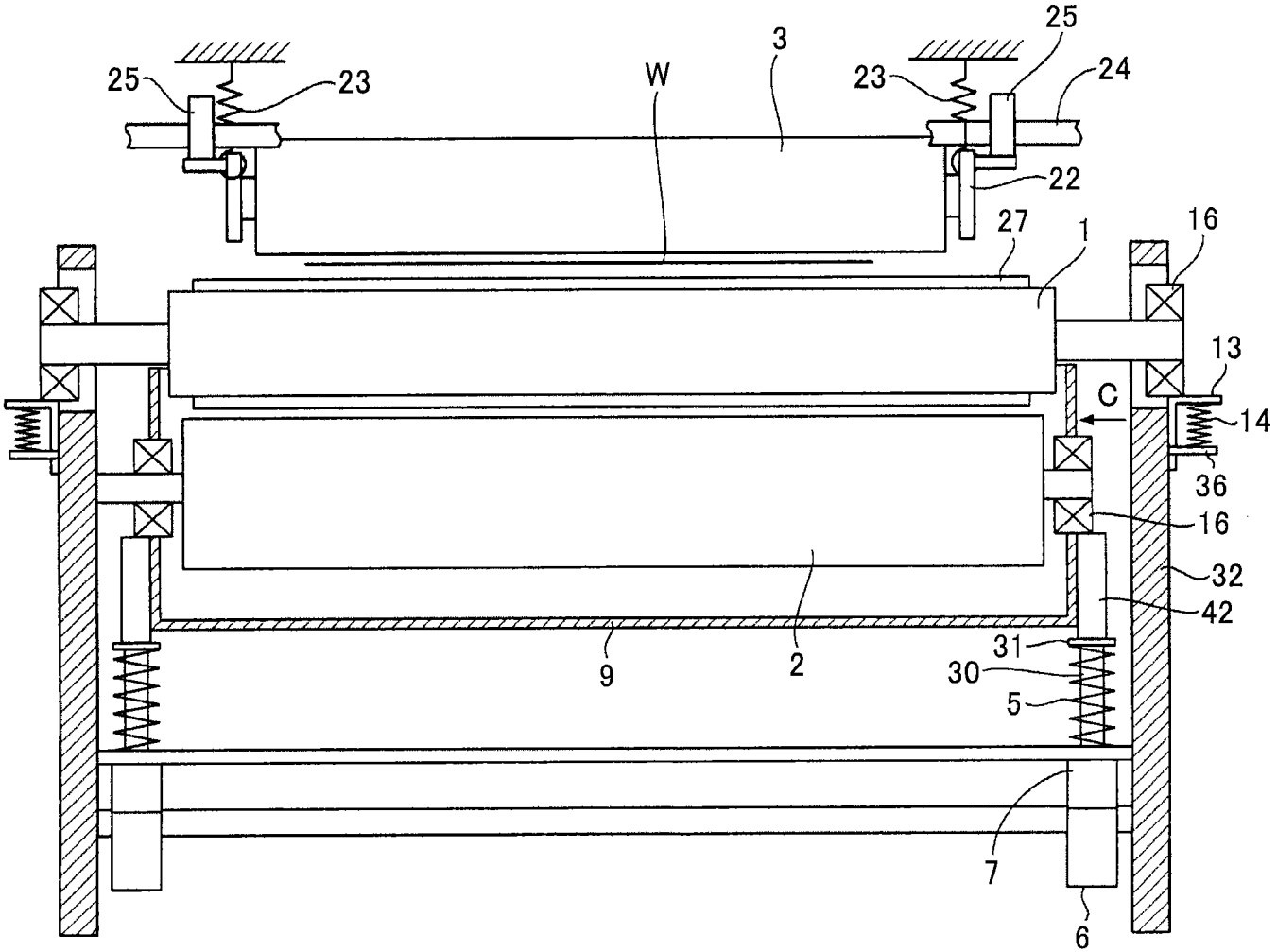
FIG. 10 is a schematic configuration diagram illustrating a treatment liquid application device according to a third embodiment viewed from a front side.
Figure 11:
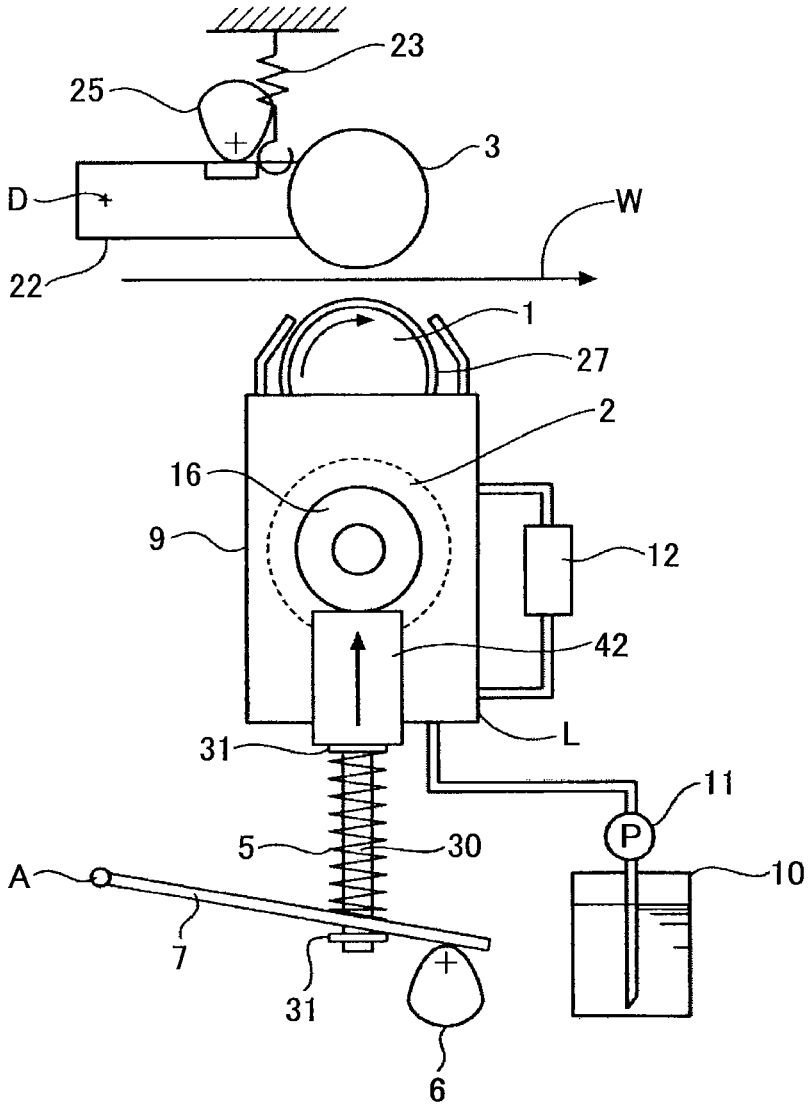
FIG. 11 is a partial diagram illustrating the treatment liquid application device viewed from a direction D of FIG. 10.

FIG. 10 is a schematic configuration diagram illustrating a treatment liquid application device according to a third embodiment viewed from a front side, and FIG. 11 is a partial diagram illustrating the treatment liquid application device viewed from a direction C of FIG. 10.

In the treatment liquid application device according to the third embodiment, plural squeeze retaining rollers are not disposed underneath the squeeze roller 2 in a longitudinal direction of the squeeze roller 2 as illustrated in FIGS. 1 to 6. In the third embodiment, raising the squeeze roller 2 in the application roller 1 direction to finally form a nip part between the squeeze roller 2 and the application roller 1 is performed by bearing members 16 disposed on two ends of the squeeze roller 2 via roller supporting members 42.

Respective stick-like holder supporting members 30 are connected to lower parts of the roller supporting members 42, and washers 31 are disposed one on each middle position and lower ends of a corresponding one of the holder supporting members 30. A slightly compressed coil-like pushup spring 5 is disposed between the washer 31 on the middle position and the washer 31 on the lower end of the holder supporting member 30.

Respective lower parts of the pushup springs 5 are supported by arms 7, and squeeze cams 6 are disposed on respective free ends of the arms 7. Note that as illustrated in FIG. 11, the free end of the arms 7 is disposed at a position opposite to a point A. Hence, the free ends of the arms 7 are constantly in contact with the respective squeeze cams 6. Each arm 7 swings based on the point A serving as a fulcrum point by rotations of the squeeze cam 6, and the swing of the arm 7 compresses the pushup spring 5. The spring load of the pushup spring 5 is transmitted to the corresponding squeeze roller 2 via the holder supporting member 30, the roller supporting member 42, and the bearing member 16. The spring load transmitted to the squeeze roller 2 pushes up the squeeze roller 2 in the application roller 1 direction to form a nip part between the squeeze roller 2 and the application roller 1.

Note that the squeeze roller 2 is configured to have sufficient rigidity with respect to the nip load used in order to prevent flexure in an axial direction of the squeeze roller 2.

In the respective configurations illustrated in FIGS. 10 and 11, a supporting structure of the application roller 1 disposed on the two ends of the application roller 1 is the same as that illustrated in FIG. 1. However, the supporting structure of the application roller 1 may be any one of the configurations illustrated in FIGS. 1 and 6. Note that the operation of the supporting structure of the application roller 1 is similar to those illustrated in the first and the second embodiments.

The effects of the embodiments may be summarized as follows. According to the embodiments, there is provided a configuration of a treatment liquid application device in which a squeeze roller and a pressure roller are configured to apply load to an application roller, and a position of the application roller is not mechanically restricted by approximate load directions of the pressure roller and the squeeze roller but is mechanically restricted by directions other than the approximate load directions of the pressure roller and the squeeze roller.

As described above, since the position of the application roller is not configured to be fixed but is configured to be displaced with respect to the load directions of the squeeze roller and the pressure roller, the application roller may be able to handle load statuses of the squeeze roller and the pressure roller. As a result, non-uniform application of a treatment liquid may be controlled and a sufficient effect of the application of the treatment liquid may be exhibited.

According to the embodiments, there is provided a configuration of the treatment liquid application device in which bearings are attached to two ends of the application roller, elongated holes are formed in a fixed member such as a frame inside the treatment liquid application device, the elongated holes each having a longitudinal diameter longer than a diameter of the bearings and a short diameter having a diameter approximately equal to the diameter of the bearings along the approximate load directions of the pressure roller and the squeeze roller, the bearings being slidably inserted in the respective elongated holes.

Hence, it may be possible to obtain the treatment liquid application device with a simple configuration in which the position of the application roller is not mechanically restricted by the approximate load directions of the pressure roller and the squeeze roller but is mechanically restricted by directions other than the approximate load directions of the pressure roller and the squeeze roller.

According to the embodiments, there is provided a configuration of the treatment liquid application device in which a circumferential surface of the application roller is covered with an elastic member such as rubber, and when the treatment liquid is not applied to a recording medium, the squeeze roller and the pressure roller are separated from the application roller. Hence, it may be possible to eliminate an adverse effect of non-uniform application of the treatment liquid due to deformation of the elastic member caused by the squeeze roller or the pressure roller being in pressure-contact with the application roller.

According to the embodiments, there is provided a configuration of the treatment liquid application device in which the treatment liquid supplied to the application roller may be blocked by separating the squeeze roller from the application roller, and a pressure-contact status in which the pressure roller and the application make a pressure-contact with each other may be maintained in a state in which the treatment liquid supplied to the application roller is blocked.

Hence, since the treatment liquid accumulated in the nip part between the pressure roller and the application roller is absorbed into the recording medium, it may be possible to eliminate the adverse effects, in which the treatment liquid that is applied to the recording medium in a dripping form may spatter to be adhered to another web transporting unit to contaminate the recording medium when the transportation of the recording medium restarts.

The embodiments provide the treatment liquid application device having the above described configuration for use in an inkjet printer. According to the embodiments, since the position of the application roller is not configured to be fixed but is configured to be displaced with respect to the load directions of the squeeze roller and the pressure roller, the application roller may be able to handle load statuses of the squeeze roller and the pressure roller. As a result, non-uniform application of a treatment liquid may be controlled and a sufficient effect of the application of the treatment liquid may be exhibited.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2013-47989 filed on Mar. 11, 2013, and Japanese Priority Application No. 2013-225744 filed on Oct. 30, 2013, the entire contents of which are hereby incorporated by reference.

What is claimed is:

1. A treatment liquid application device for use in an inkjet printer, the treatment liquid application device comprising:

an application roller configured to apply a treatment liquid to a recording medium before an image is formed on the recording medium;

a squeeze roller disposed below the application roller and configured to make a pressure-contact with the application roller;

a treatment liquid supply unit configured to supply the treatment liquid to a nip part between the application roller and the squeeze roller; and a pressure roller disposed above the application roller and configured to cause the recording medium to make a pressure-contact with the application roller, wherein the squeeze roller and the pressure roller are configured to apply respective loads to the application roller, and wherein when the application roller applies the treatment liquid to the recording medium, a position of the application roller is not restricted in approximate load directions of the squeeze roller and the pressure roller, and the position of the application roller is restricted in directions other than the approximate load directions.

2. The treatment liquid application device as claimed in claim 1, further comprising:

respective bearings attached to two ends of the application roller, wherein elongated holes are formed in a fixed member inside the treatment liquid application device, the elongated holes each having a longitudinal diameter longer than a diameter of the bearings and a short diameter having a diameter approximately equal to the diameter of the bearings along the approximate load directions of the pressure roller and the squeeze roller, the bearings being slidably inserted in the respective elongated holes.

3. The treatment liquid application device as claimed in claim 1, wherein a circumferential surface of the application roller is covered with an elastic member, and wherein when the treatment liquid is not applied to a recording medium, the squeeze roller and the pressure roller are separated from the application roller.

4. The treatment liquid application device as claimed in claim 1, wherein the treatment liquid is supplied to the nip part between the application roller and the squeeze roller by rotating the squeeze roller while making a pressure-contact with the application roller, wherein the treatment liquid stops being supplied to the application roller by separating the squeeze roller from the application roller, and wherein a pressure-contact status in which the pressure roller and the application roller make a pressure-contact with each other is maintained in a state in which the treatment liquid supplied to the application roller is stopped.

5. The treatment liquid application device as claimed in claim 4, wherein the pressure roller is configured to further press the application roller in the state in which the treatment liquid supplied to the application roller is stopped.

6. The treatment liquid application device as claimed in claim 4, wherein the application roller is configured to further press the pressure roller in the state in which the treatment liquid supplied to the application roller is stopped.

7. An image forming system comprising:

a treatment liquid application device configured to apply a treatment liquid to a recording medium before an image is formed on the recording medium; and an inkjet printer configured to eject ink droplets onto the recording medium to which the treatment liquid is applied, wherein the treatment liquid application device is the treatment liquid application device as claimed in claim 1.

8. The treatment liquid application device as claimed in claim 1, further comprising:

a standby mode, wherein the application roller, the squeeze roller, and the pressure roller are spaced apart from one another;

an application preparation mode, wherein the application roller and the squeeze roller are in contact with each other and the pressure roller is spaced apart from the application roller and the squeeze roller;

an application mode, wherein the application roller and the squeeze roller are in contact with each other and the pressure roller presses on the application roller; and a stop preparation mode, wherein the application roller and the squeeze roller are spaced apart and the pressure roller presses on the application roller.

9. An application method for use in a treatment liquid application device including an application roller configured to apply a treatment liquid to a recording medium before an image is formed on the recording medium; a squeeze roller disposed below the application roller and configured to make a pressure-contact with the application roller; a treatment liquid supply unit configured to supply the treatment liquid to a nip part between the application roller and the squeeze roller; and a pressure roller disposed above the application roller and configured to cause the recording medium to make a pressure-contact with the application roller, wherein the squeeze roller and the pressure roller are configured to apply respective loads to the application roller, and wherein when the application roller applies the treatment liquid to the recording medium, a position of the application roller is not restricted in approximate load directions of the squeeze roller and the pressure roller, and the position of the application roller is restricted in directions other than the approximate load directions, the application method comprising:

maintaining the application roller, the squeeze roller, and the pressure roller to be away from one another in a standby mode;

causing the application roller and the squeeze roller to be in contact with each other while maintaining the pressure roller to be away from the application roller and the pressure roller in an application preparation mode;

causing the application roller to be in contact with the squeeze roller and the pressure roller in an application mode; and causing the application roller and the pressure roller to be in contact with each other while maintaining the squeeze roller to be away from the application roller and the pressure roller in an application stop preparation mode.

* * * * *